United States Patent [19]

Biegon et al.

[11] Patent Number: 4,767,891

[45] **Date of Patent: * Aug. 30, 1988**

[54] MASS TERMINABLE FLAT CABLE AND CABLE ASSEMBLY INCORPORATING THE CABLE

[75] Inventors: Robert J. Biegon, Aurora; Grigory Men, Naperville, both of Ill.; Lester T. Turner, Tompkinsville, Ky.; Douglas Lindstrand, Elburn, Ill.; Albert R. Cox, Plymouth, Ind.

[73] Assignee: Cooper Industries, Inc., Houston, Tex.

[ * ] Notice: The portion of the term of this patent subsequent to Nov. 25, 2003 has been disclaimed.

[21] Appl. No.: 51,933

[22] Filed: May 19, 1987

Related U.S. Application Data

[63] Continuation-in-part of Ser. No. 798,997, Nov. 18, 1985, abandoned.

[51] Int. Cl.[4] ..... H01B 11/02; H01B 7/08

[52] U.S. Cl. ..... 174/34; 174/36; 174/72 A; 174/112; 174/117 F; 174/131 A

[58] Field of Search ..... 174/117 R, 117 F, 117 FF, 174/117 A, 72 A, 34, 36, 112, 113 C, 131 A, 109; 439/494, 495; 156/51, 52

[56] References Cited

U.S. PATENT DOCUMENTS

| | | | |
|---|---|---|---|
| 2,155,460 | 4/1939 | Phillips | 174/113 |
| 2,851,515 | 9/1958 | Kolmorgen et al. | 174/117 |
| 3,082,292 | 3/1963 | Gore | 174/117 F |
| 3,168,617 | 2/1965 | Richter | 339/17 F |
| 3,239,396 | 3/1966 | Bohannon, Jr. | 156/52 |
| 3,321,572 | 5/1967 | Garner | 174/36 |
| 3,325,589 | 6/1967 | Mildner | 174/36 |
| 3,459,878 | 8/1969 | Gressitt et al. | 74/112 |
| 3,489,844 | 1/1970 | Motley | 174/34 |
| 3,609,216 | 9/1971 | Copp | 174/133 R |
| 3,644,659 | 2/1972 | Campbell | 174/34 X |
| 3,733,428 | 5/1973 | Fry | 174/72 A |
| 3,736,366 | 5/1973 | Mittenberg | 174/112 X |
| 3,836,415 | 9/1974 | Hilderbrandt | 156/296 |
| 4,096,006 | 6/1978 | Paquin | 156/55 |
| 4,146,302 | 3/1979 | Jachimowicz | 174/72 TR |
| 4,300,017 | 11/1981 | Sergretto et al. | 174/36 |
| 4,381,426 | 4/1983 | Cronkite et al. | 174/117 F |
| 4,406,915 | 9/1983 | Lang | 174/117 F |
| 4,443,277 | 4/1984 | Rokas | 174/34 X |
| 4,460,804 | 7/1984 | Svejkovsky | 174/117 A |
| 4,468,089 | 8/1984 | Brorein | 350/96.23 |
| 4,477,693 | 10/1984 | Krabec et al. | 174/36 |
| 4,552,989 | 11/1985 | Sass | 174/109 X |
| 4,625,074 | 11/1986 | Cox | 174/117 |

FOREIGN PATENT DOCUMENTS

| | | | |
|---|---|---|---|
| 2715585 | 10/1978 | Fed. Rep. of Germany | 174/113 C |
| 20578 | 2/1978 | Japan | 174/117 F |
| 1432548 | 4/1976 | United Kingdom | 174/112 |

*Primary Examiner*—Morris H. Nimmo

*Attorney, Agent, or Firm*—Fitch, Even, Tabin & Flannery

[57] ABSTRACT

A flat cable for use with a mass termination connector having a plurality of regularly spaced terminal elements. The flat cable includes a laminated carrier film and a plurality of discrete conductors held in regularly spaced parallel relationship by the carrier film to match the terminal element spacing of the connector. Each conductor has an insulating jacket made of a thermoplastic material. The carrier film includes an attachment layer of thermoplastic insulatioln having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material. The jackets of the conductor are fused to the attachment layer, and the attachment layer is held by the stabilization layer. The carrier film can be longitudinally discontinuous to form first cable sections where the conductors are held parallel for ease of termination, and second cable sections where the conductors are not held to increase flexibility and reduce weight. The cable can also be formed into a round configuration to provide advantages during routing, and locating indicia can be applied to the outside surface.

27 Claims, 4 Drawing Sheets

MASS TERMINABLE FLAT CABLE AND CABLE ASSEMBLY INCORPORATING THE CABLE

This application is a continuation-in-part of copending United States patent application Ser. No. 798,997 filed Nov. 18, 1985, now abandoned.

The present invention relates to electrical wiring components and, more specifically, to a cable assembly incorporating a flat cable adapted for use with mass termination, insulation displacement connectors.

BACKGROUND OF THE INVENTION

Mass termination, insulation displacement connectors have come into increasing commercial prominence because of the significant savings in time and labor they offer compared to stripping and individually terminating each conductor using a crimp terminal. These connectors have an insulative housing body holding a number of regularly spaced terminal elements having slotted plates terminating in sharpened free ends extending beyond a surface of the body. The conductors also include covers having recesses in a facing surface for receiving the free ends of the plates. After the insulated conductors are aligned with their corresponding slotted plates, relative closing of the housing body and cover results in displacement of the insulation with the conductor cores contacting the metallic plates. For further information regarding the operation and structure of such mass termination connectors, reference may be made to U.S. Pat. Nos. 4,458,967 and 3,912,354.

The most efficient form of conductors for use with such connectors is the flat cable in which conductors, running parallel and spaced to match the spacing of the terminal elements in the connector, are held by a layer of insulation. The use of a flat cable avoids running the conductors one at a time and holding them in position for termination. The flat cable can be used for either a daisy chain connection (where the connector is applied intermediate the cable ends) or an end connection. The sharpened ends of the slotted plates pierce the web material between the conductors in the flat cable as the body and cover close so slitting of the cable between conductors is not required.

While flat cables offer many advantages with respect to efficiency in termination, they present difficulties during routing. Flat cables have certain dimensions larger than comparable round cables, the flat cables do not bend as easily, they are more susceptible to damage during routing, and the continuous presence of the layer of insulation holding the discrete conductors may result in somewhat increased weight of a flat cable.

There are several methods for manufacturing flat cable. In one method, the insulation is extruded about parallel, coplanar conductors. In another, two layers of insulation are bonded together with the conductors held in parallel, coplanar relationship. Some of these methods require the use of large expensive manufacturing equipment. One simpler manufacturing method has been proposed wherein individual conductors, each having a thermoplastic jacket, are positioned on a layer of the same material as that used in the jackets. Upon raising the temperature to the melting point of the insulation, the jackets and layer will fuse, forming a flat cable. Unfortunately, the most commonly used insulating materials, such as polyvinyl chloride, have poor dimensioned stability, particularly when the flat cable is subjected to varying temperatures.

A method of forming flat cable using conductor modules has also been suggested. In this method, pairs of conductors are formed into modules by applying a jacket of insulation about them. The modules are fed in edge-to-edge relationship between two webs of polyester material precoated with a hot-melt adhesive on their facing surfaces. This assembly is then subjected to heating and the application of pressure to form the final flat cable assembly. For additional information concerning this flat cable and its method of manufacture, reference may be made to U.S. Pat. No. 4,468,089.

Another flat cable includes twisted pairs of wires having straight wire portions wherein the wires are maintained in their spaced, parallel relationships by means of discrete insulative strips. Yet another flat cable includes twisted pair sections spaced by straight wire portions with upper and lower films extending the entire length of the cable with the films heat welded between conductors. For further information regarding the structure and operation of these cables, reference may be made to U.S. Pat. Nos. 3,459,878 and 4,096,006, respectively.

SUMMARY OF THE INVENTION

Among the several aspects of the present invention may be noted the provision of an improved flat cable adapted for use with mass termination, insulation displacement connectors. The cable has greater strength, increased dimensional stability over a wide temperature range, lighter weight, and smaller finished cable thickness than conventional flat cables which employ a carrier film of the same insulating material as the jacket on the conductor cores. A cable embodying features of the present invention can be reconfigured from substantially round to flat. The cable is very flexible and, in one embodiment, has undulations on both sides so that the pockets on the connector body can be used to locate the cable without regard to its orientation. The cable of the present invention is reliable in use, has long service life and is simple and economical to manufacture. Other aspects and features of the present flat cable will be, in part, apparent and, in part, pointed out hereinafter in the following specification and in the accompanying claims and drawings.

Briefly, the flat cable of the present invention includes a laminated carrier film and a plurality of discrete conductors held in regularly spaced parallel relationship by the carrier film to match the terminal elements spacing of the connector. Each conductor has an insulative jacket made of a thermoplastic material. The carrier film includes an attachment layer of thermoplastic insulation having a melting temperature similar to that of the jacket material. The carrier film also includes a dimensional stabilization layer holding the attachment layer and made of an insulative material having a melting temperature higher than those of the attachment layer and the jacket material and displaying dimensional stability at the melting temperatures of the attachment layer and the jacket material. The jackets of the conductors are fused to the attachment layer. The carrier film can be longitudinally discontinuous to form first cable sections where the conductors are held parallel for ease of termination and second cable sections where the conductors are not held to increase flexibility and reduce weight. The cable can be formed into a round configuration to provide advantages during routing.

As a method of manufacturing a flat cable, the present invention includes several steps: (1) The jacketed conductors are positioned against the attachment layer so that the spacing of the conductors matches that of the terminal elements in the connector. (2) The temperatures of the conductors jackets and the attachment layer are raised until the jackets and the attachment layers fuse. (3) The conductors have their positions maintained on the attachment layer until the temperatures of the jackets and the attachment layer drop sufficiently so that the jackets are fixed.

BRIEF DESCRIPTION OF THE DRAWINGS

Corresponding reference numbers indicate corresponding components throughout the several views of the drawings.

DESCRIPTION OF THE PREFERRED EMBODIMENT

Figure 2:
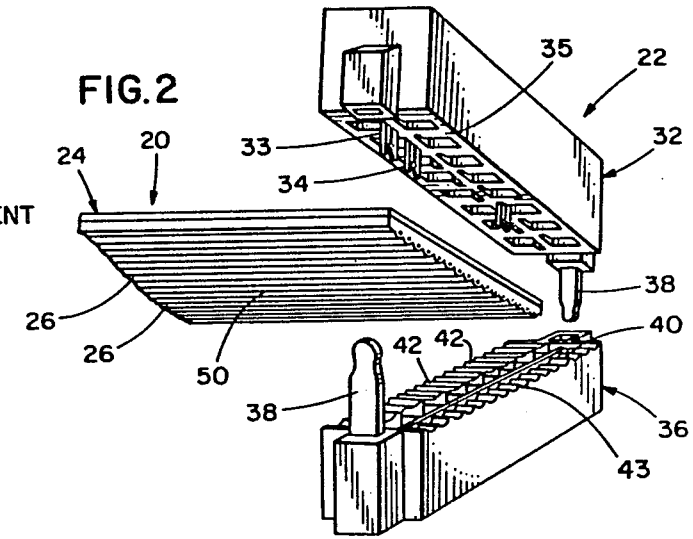
FIG. 2 is an exploded perspective view showing a mass termination insulation displacement connector usable with the cable of FIG. 1.

Referring now to the drawings, a flat cable of the present invention adapted for use with a mass termination, insulation displacement connector 22 (shown in FIG. 2), is generally indicated by reference numeral 20. The flat cable 20 includes a laminated carrier film 24 and a plurality of discrete conductors 26 held in regularly spaced, parallel relationship by the carrier film. Each conductor 26 includes a metallic, i.e., copper, core 28 and an insulating jacket 30 about the core. While the particular flat cable illustrated is intended for carrying electrical signals and has the cores on 0.050 inch centers, it will be appreciated that the flat cable 20 of the present invention can be made in various centers.

The exemplary mass termination connector 22 shown in FIG. 2 is of the high terminal density, signal conductor type and includes an insulative body 32 having two rows of terminal element cavities. A terminal element 33 is disposed in each cavity with elements in each row having a 0.100 inch pitch. It will be appreciated that connectors having more than two rows of terminal elements are also usable with the cable of the present invention. Adjacent terminal elements in each row are staggered so that every other conductor 26 is terminated by elements in one row while the remaining conductors are terminated by the elements in the other row. Each terminal element includes a slotted plate 34 extending beyond a surface 35 of the body with the plate terminating in sharpened ends for piercing the web material of the flat cable between the conductors. The plate edges defining the slot function to displace the conductor jacket material so that by forcing a conductor 26 into a slotted plate 34, the conductor core 28 is engaged by the metallic plate to establish an electrical circuit. The connector 22 also includes a cover 36 held in alignment with the body 32 by means of pins 38. The cover, also formed of insulating material, includes a facing surface 40 having pockets 42 for locating the flat cable conductors 26 with respect to the terminal elements 33, and a recess 43 for receiving the free ends of the slotted plates 34. Thus after the flat cable 20 is positioned between the cover 36 and the body 32, relative closing of the two results in mass termination of the conductors 26 of the flat cable 20.

Figure 1:
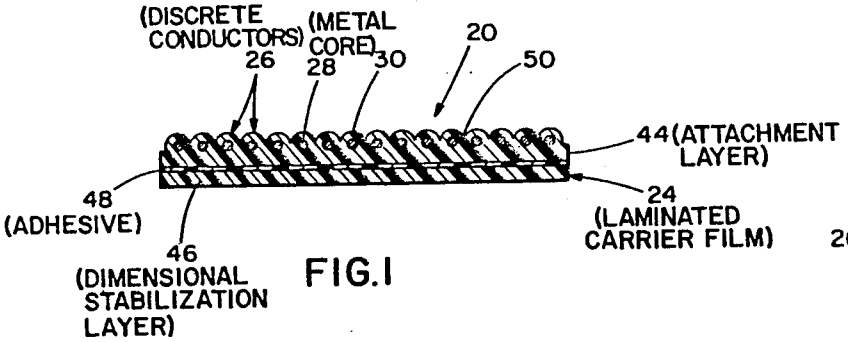
FIG. 1 is an end view of the mass terminable flat cable of the present invention.

Referring to FIG. 1, the carrier film 24 includes an attachment layer 44 of a thermoplastic insulation having a melting temperature similar to that of the jacket material 30, and a dimensional stabilization layer 46 made of an insulating material having a melting temperature higher than those of the attachment layer and the jacket material and displaying dimensional stability at the melting temperatures of the attachment layer and the jacket material. The jackets 30 of the conductors 26 are fused to the attachment layer 44 and the attachment layer is held by the stabilization layer 46 preferably by bonding them together with an adhesive 48, or the attachment layer and the stabilization layer may themselves be fused. Also preferably the attachment layer 44 and the conductor jackets 30 are made of the same insulating material. Among the several combinations of insulating materials are the following: polyvinyl chloride jackets and attachment layer with polyester stabilization layer; fluorinated ethylene-propylene jackets and attachment layer with tetrafluoroethylene stabilization layer; polyethylene jackets and attachment layer with polyester stabilization layer; and polypropylene jackets and attachment layer with polyester stabilization layer.

With respect to the first combination, polyester offers a greater strength to weight ratio than polyvinyl chloride. Also polyester has better dimensional stability over a wide range of thermal and environmental conditions. The other combinations offer similar characteristics. Thus the cable 20 can have greater strength, better temperature stability, smaller thickness and lighter weight than a conventional flat cable which uses a carrier layer of the same insulating material as the conductor jackets. Additionally, the polyester stabilization layer 46 serves a strain relief function when mass termination connectors including strain clips are employed. Upon tensioning of the flat cable between connectors, the polyester layer resists extension of the jackets and the metallic conductor cores.

It will also be appreciated that the flat cable 20 has a side 50 which is undulating, with the undulations formed by the individual jackets 30. These undulations are received by the pockets 42 in the connector cover 36 to properly locate the various cores 28 in alignment with their corresponding slotted plates 34. This is advantageous over a flat cable having flat sides because the connector does not have to be provided with alignment stops at the sides of the cover and/or body to position the flat cable in position for termination.

Figure 3:
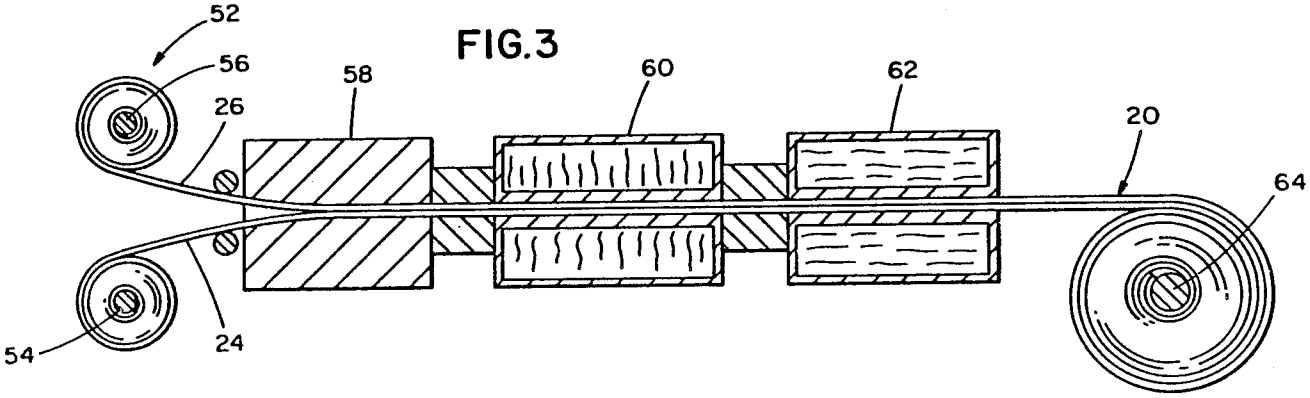
FIG. 3 is a simplified diagrammatic representation of a method of manufacturing the cable of FIG. 1.

As shown diagrammatically in FIG. 3, the flat cable 20 of the present invention is relatively simple to manufacture using a continuous process. At a feed station 52 are positioned a roll 54 of the carrier film and a number of spools 56 of the conductors 26. The carrier film and the plurality of the conductors are received by a positioning die 58 which aligns the various conductors 26 in regularly spaced, parallel relationship on the attachment layer 44 of the carrier film. The die has conductor-receiving passageways which decrease in dimension from the die entrance side to its exit side so that upon exit of the cable components, the conductors are held firmly against the attachment layer. The film and conductors next pass through a heating zone 60 where the temperatures of the jacket material and the attachment layer are raised sufficiently that the conductors and attachment layer fuse. Next downstream is a cooling zone where another die 62 functions firmly to hold the conductors against the attachment layer until the jackets are fixed onto the attachement layer. Finally, the completed flat cable 20 is wound on a take up reel 64. The above description assumes that the formation of the carrier layer has been completed. The carrier layer 24 can also be formed as a preliminary operation in this manufacturing process by including an upstream station where the attachment layer and stabilization layer are bonded.

As a method of manufacturing a flat cable for use with a mass termiation connector 22 having regularly spaced terminal elements 33, the present invention includes the following steps:

(1) The jacketed conductors 26 are positioned in parallel spaced relationship against the carrier film 24 so that the conductor engage the attachment layer 44 with the spacing between the conductors matching that of the terminal elements in the connector.

(2) The temperatures of the conductor jackets 30 and the attachment layer 44 are raised so that the jackets and the attachment layer fuse. However, the temperature of the stabilization layer 46 remains below its melting temperature.

(3) The positioning of the conductors is maintained until the temperatures of the jackets and the attachment layer drop sufficiently so that the jackets become fixed on the attachment layer.

It will be appreciated that the particular construction of the flat cable 20 allows the use of different insulating materials for the jackets 30 of the conductors in the same manufacturing process without requiring modification of expensive equipment components. This is because of the great flexibility offered by cable 20. If a particular insulation is required for the conductor jackets, only the attachment layer coating on the polyester film stabilization layer need by changed to match the jacket material used in the conductors 26.

While the flat cable is shown with the conductors running parallel throughout the length of the cable, the cable could alternatively have sections wherein adjacent conductors form twisted pairs with those sections spaced by other sections wherein the conductors run parallel to one another.

Figure 4:
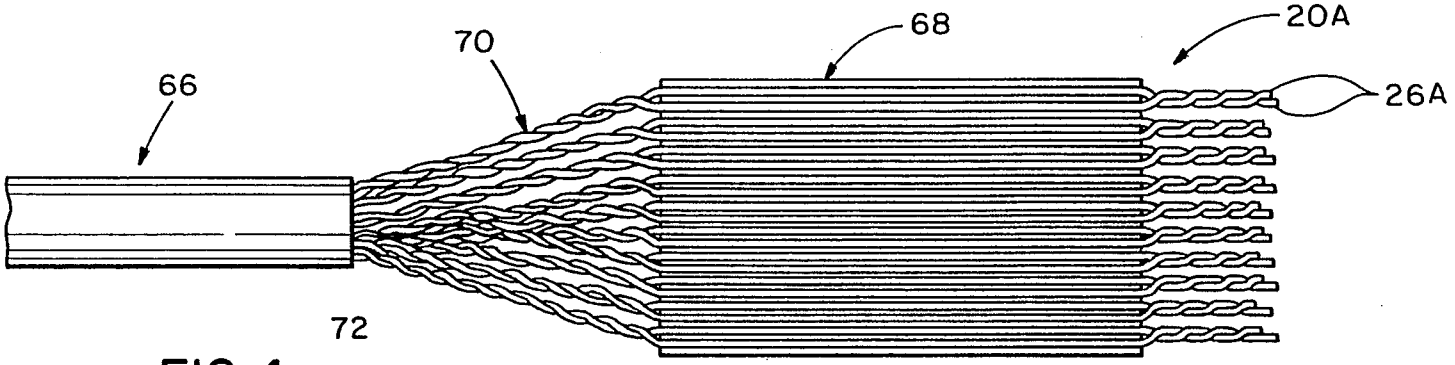
FIG. 4 is a plan view of a cable assembly incorporating an alternative embodiment of a cable embodying various features of the present invention wherein the cable can be reconfigured from a round configuration to a flat configuration by removal of an outer protective sheath, and wherein first cable sections in which conductors run parallel and are held by a carrier film are spaced by second cable sections which do not have the carrier film and in which the conductors are paired and twisted.
Figure 5:
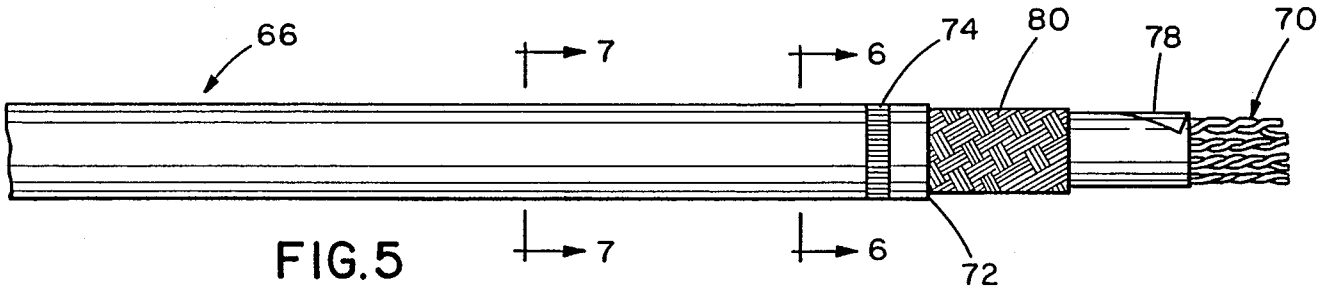
FIG. 5 illustrates the cable assembly of FIG. 4 with certain components removed and with the cable in its round configuration throughout its length.
Figure 7:
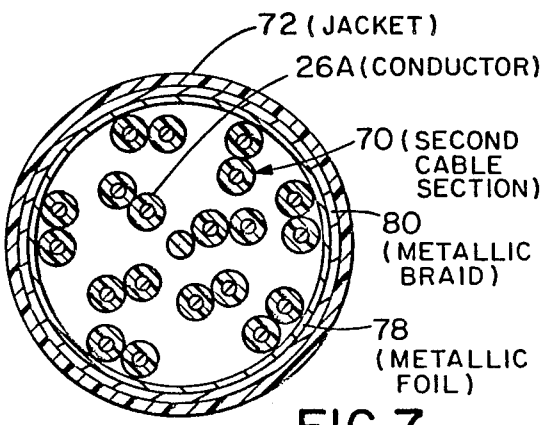
FIG. 7 is a cross-sectional view taken generally along line 7—7 of FIG. 5 through a second cable section.

Referring now to FIGS. 4–8, a cable assembly 66 is shown which includes an alternative embodiment 20A of the flat cable of the present invention. Components of the flat cable 20A corresponding to components of the flat cable 20 are indicated by the reference numeral applied to the component of the flat cable 20 with the addition of the suffix "A". As shown in FIG. 4, the flat cable 20A is longitudinally divided into a plurality of spaced first cable sections 68 in which the conductors 26A are held in regularly spaced, parallel relationship by carrier film 24A by means of the attachment layer 44A being fused with the conductor jackets, and a plurality of second cable sections 70 wherein the conductors are not held. The conductors in the second sections 70 are preferably disposed in twisted pairs, as shown in FIGS. 4 and 5, or the conductors may be in an unpaired configuration. A second cable section 70 spaces each adjacent pair of first cable sections 68. The first cable sections 68 are preferably regularly spaced and are somewhat shorter than the second cable sections 70. The first cable sections are used for termination of the conductor cores 28A by the insulation displacement connectors 22 because it is at the first cable sections where the conductors are held in a regularly spaced array having centers matching those of the terminal elements 33 of the connector. On the other hand, the presence of the second cable sections 70 with the loose twisted pairs provides greater flexibility, lighter weight.

The flat cable 20A, when part of the cable assembly 66, is deformed into a non-flat and preferably substantially circular configuration. The cable assembly 66 includes an outer jacket 72 constituting means disposed about the periphery of the cable 20A for holding the cable in its preferably circular cross-sectional configuration. The outer jacket is formed of a tough, abrasion resistant thermoplastic material and the outer surface of the jacket 72 carries spaced indicia 74 (such as a circular stripes) to locate the presence of the first cable sections 68. Thus, the user can easily find a first cable section, strip the outer jacket therefrom and apply a connector 22 after returning the cable section to its flat configuration. The round configuration of the cable 20A when held in the cable assembly 66 provides many advantages when the cable assembly is routed. A round configuration has smaller dimensions, is more flexible in certain directions (a flat cable configuration has restricted bending in the plane of the flat cable) and is more resistant to damage during routing, for example, during pulling of the cable assembly through a conduit.

Figure 8:
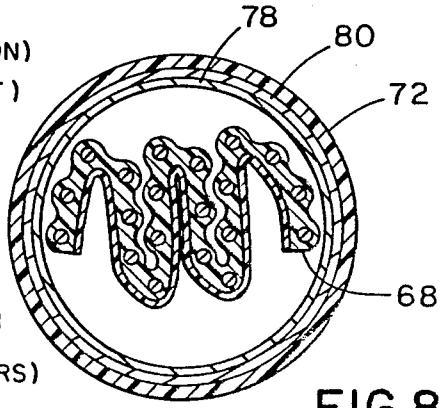
FIG. 8 is a cross-sectional view of an alternative embodiment of the cable of FIG. 4 wherein the flat cable is folded instead of spiralled.
Figure 6:
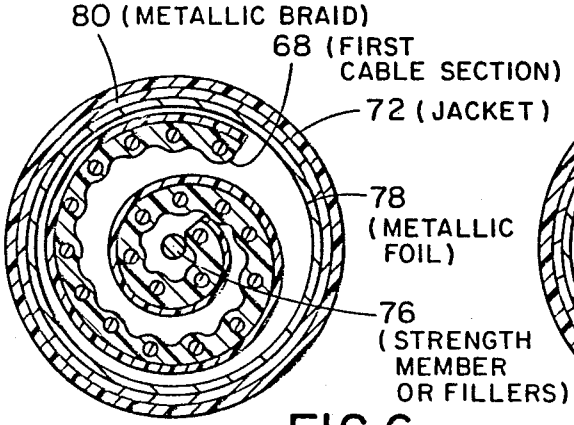
FIG. 6 is a cross-sectional view taken generally along line 6—6 of FIG. 5 through a first cable section in which the cable is spiralled around a central strength member.

The flat cable 20A can be deformed from its flat, as-manufactured configuration to the substantially round configuration by spiralling, as shown in FIG. 6, or by folding, as shown in FIG. 8. A central strength member 76, formed by a fiber or steel stranded rope, may be provided. Additional strength members and/or fillers could also be provided inside cable assembly 66. The spiralled configuration offers certain advantages in that the deformed cable more closely resembles a round configuration without extensive use of fillers with the cable 20A inside the outer jacket 72, and the cable 20A is not required to undergo severe bending. On the other hand, the accordian folded cable shown in FIG. 8 can quickly be returned to its flat configuration by pulling apart the lateral sides of the exposed first cable section.

Optionally, as shown in FIG. 5, the cable assembly 66 can include a metallic shield encompassing the deformed flat cable 20A. The shield comprises a foil 78 which might be on Mylar (Mylar is a registered trademark of Dupont for polyester film) and/or a metallic braid 80. Optimum shielding is achieved using the foil 78 disposed under the braid 80 and in contact therewith, the use of the braid over the foil results in the lowest radio frequency leakage and lowest susceptibility to electrical noise. The braid functions to limit penetration of low frequency noise while the presence of the foil limits high frequency noise penetration.

Figure 9:
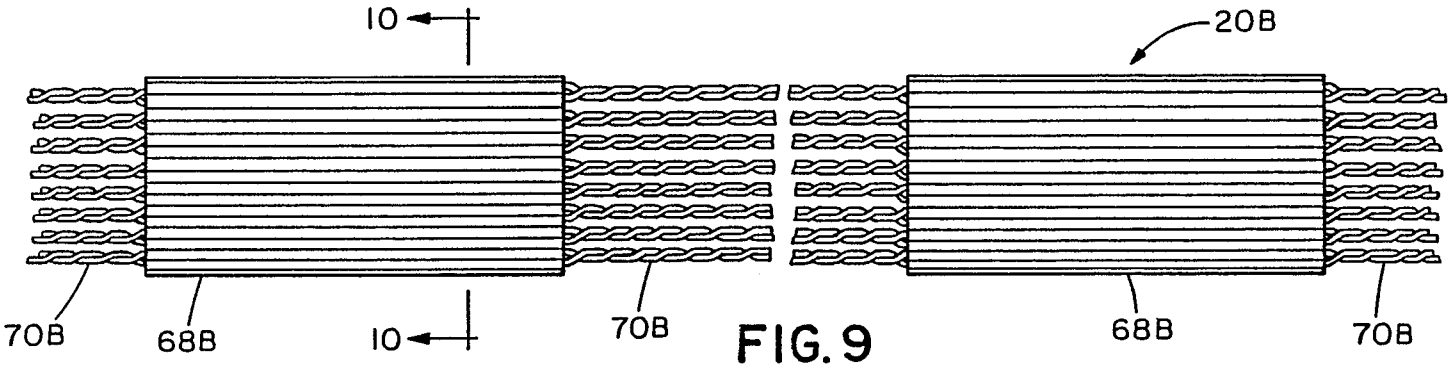
FIG. 9 is a plan view of yet another alternative embodiment of a flat cable incorporating various features of the present invention wherein carrier films are disposed on both sides of the conductors in the first cable sections in which the conductors are run parallel.
Figure 10:
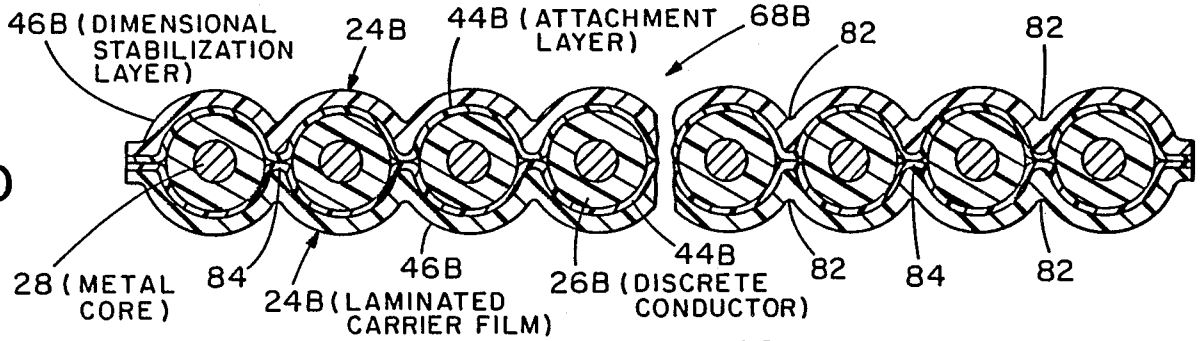
FIG. 10 is a cross-sectional view taken generally along line 10—10 of FIG. 9.

Referring to FIGS. 9 and 10, another alternative embodiment 20B of the flat cable of the present invention is shown. Components of the flat cable 20B corresponding to components of flat cables 20 or 20A are indicated by the reference numeral applied to the component of the previously described cable with the addition of the suffix "B". The flat cable 20B is similar to the flat cable 20A in that it is longitudinally divided into a plurality of spaced first cable sections 68B in which the conductors 26B are held in regularly spaced, parallel relationship. The flat cable 20B can also be formed into a cable assembly 66B of round cross section, as previously discussed with respect to flat cable 20A. Sections 68B are spaced by second cable sections 70B in which the conductors, which are not held, are in twisted pairs. In flat cable 20B, however, the conductors 26B in the first cable sections 68B are held by strips of carrier film 24B disposed on each side of the conductors.

Referring to FIG. 10, each film 24B preferably includes an attachment layer 44B of thermoplastic insulation having a melting temperature similar to that of the conductor jacket material, and a dimensional stabilization layer 46B made of an insulative material having a melting temprature higher than those of the attachment layers and the jacket material. The attachment layers 44B ,are fused to each other between each adjacent pair of conductors 26B to form depressions 82 on both sides of the cable 20B. These depressions, along with the crests formed by the presence of the conductors, constitute locating means for cooperating with the pockets 42 of the connector cover 22 to properly seat the flat cable 20B with respect to the terminal elments 33 without regard to which side of the cable faces the cover. An additional advantage of the attachment layer being fused together between each pair of conductors is that thin hinges 84 are formed which increases the flexibility of the cable 20B. The absence of the films 24B at the second cable sections reduces the weight of the cable. The attachment layers 44B may also be fused with the jacket material of the conductors 26B.

Figure 11:
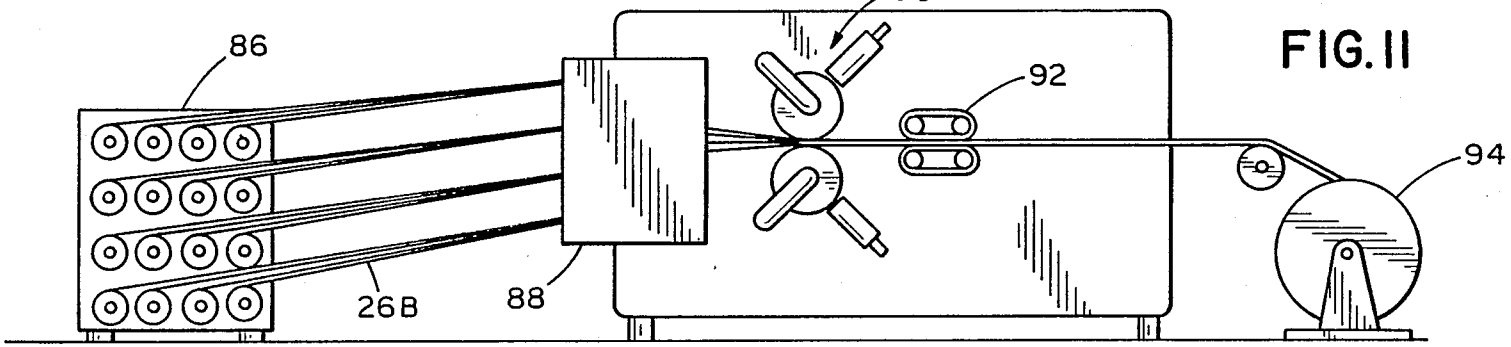
FIG. 11 is a drawing, partially in block form and partially in schematic form, showing apparatus for manufacturing the cable assembly of FIGS. 9 and 10.
Figure 12:
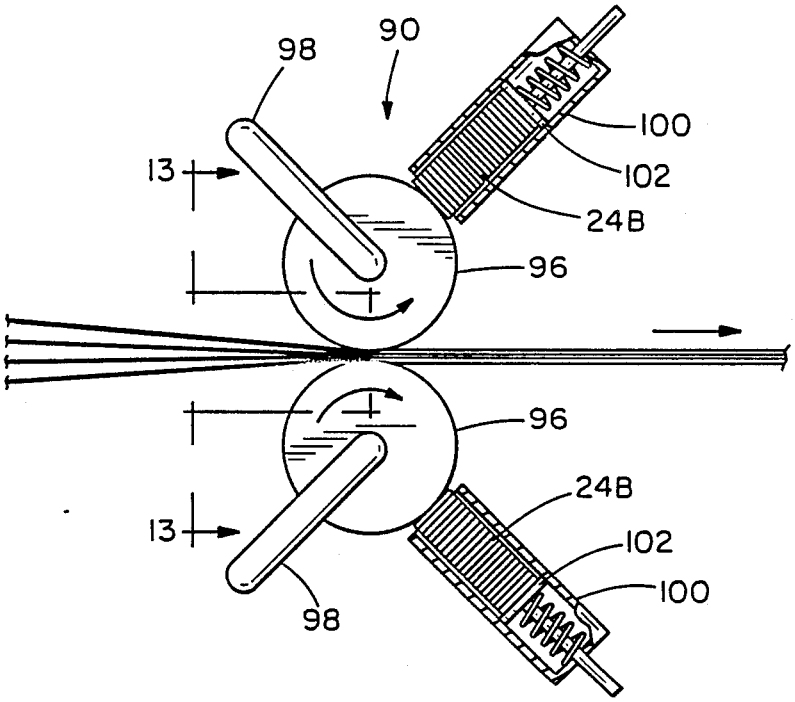
FIG. 12 is a more detailed drawing of a station for holding and applying carrier films.
Figure 13:
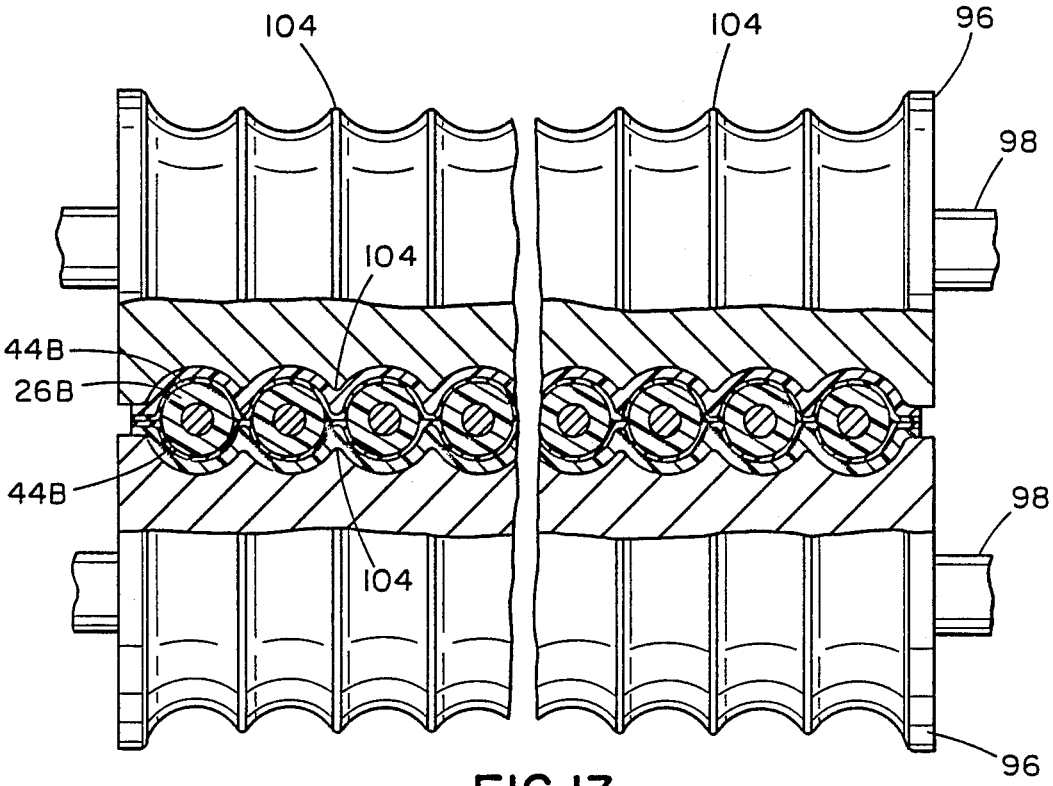
FIG. 13 is a sectional view taken generally along line 13—13 of FIG. 12 illustrating grooved rollers.

Apparatus for use in manufacturing the flat cable 20B is shown in FIGS. 11–13. Among the stations used in the apparatus are a wire let-off station 86 for concurrently dispensing a plurality of the conductors 26B and a wire twisting station 88 for selectively twisting the pairs of conductors in the second cable sections 70B. As such stations are well known to those of skill in the art, they need not be further described here. Next downstream is a film application station 90 for selectively, concurrently applying the films 24B to opposed sides of the conductors to form the first cable sections 68B. Following the film application station is a cable capstan drive means 92 which can drive the cable at different speeds, followed by a cable take-up station 94. Such drive means and take-up station are also well known by those of skill in the art.

Referring to FIGS. 12 and 13, the film application station 90 includes a pair of grooved rollers 96, rotatably held by supports 98, between which pass the conductors 26B. Associated with each roller 96 is a magazine 100 holding a stack of film strips 24B urged toward its associated roller by a spring biased presser foot 102. Heat is applied to the rollers and they are provided with a vacuum pick-up to take the leading strip with each revolution of the roller. As each magazine has the same angular orientation with respect to the pass path of the conductors, the respective leading strips of each magazine are concurrently picked up by the rollers and are concurrently rolled against the conductors 26B. Due to the application of heat and pressure by the rollers, the attachment layers 44B of the respective film strips 24B fuse to each other at the crests 104 of the grooved rollers 96 which are located between adjacent conductors. The drive means 92 controls the speed of the conductors 26B through the film application station 90 when the film strips 24B are being applied to allow sufficient time for the fusion and subsequent cooling of the strips below the fusion temperature.

In view of the above, it will be seen that the several objects of the invention are achieved and other advantageous results attained.

As various changes could be made without departing from the scope of the invention, it is intended that all matter contained in the above description shall be interpreted as illustrative and not in a limiting sense.

What is claimed is:

1. A flat cable for use with a mass termination connector having a plurality of regularly spaced terminal elements, said cable comprising:

a plurality of discrete conductors extending throughout the length of said cable, each conductor having an insulative jacket made of a thermoplastic material;

said cable having a plurality of spaced first cable sections in which said conductors are held in regularly spaced parallel relationship, said cable further having a plurality of spaced second cable sections in which said conductors are not held in regularly spaced parallel relationship, with adjacent first cable sections being spaced by a second cable section;

each first cable section comprising a laminated carrier film holding said conductors, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer.

2. A flat cable as set forth in claim 1 wherein in said second cable sections said conductors are arranged in twisted pairs.

3. A flat cable as set forth in claim 1 wherein the conductor jackets and the attachment layer are made of the same material.

4. A flat cable as set forth in claim 1 wherein the said attachment layer is formed of polyvinyl chloride.

5. A flat cable as set forth in claim 1 wherein said stabilization layer is made of a polyester film.

6. A flat cable as set forth in claim 1 wherein each of said first cable sections has a substantially flat side and an opposite undulating side with each undulation formed by one of the jacketed conductors.

7. A flat cable as set forth in claim 1 wherein said carrier film comprises an adhesive bonding said attachment layer to said stabilization layer.

8. A cable assembly for use with a mass termination connector having a plurality of regularly spaced terminal elements, said cable assembly comprising:

a flat cable deformed from its flat, as-manufactured configuration into a non-flat configuration; and holding means disposed about the periphery of said cable holding said cable in said non-flat configuration whereby removal of the holding means allows said cable substantially to return to its flat configuration, said cable in its as-manufactured configuration comprising:

a plurality of discrete conductors extending throughout the length of said cable, each conductor having an insulative jacket made of a thermoplastic material;

said cable having a plurality of spaced first cable sections in which said conductors are held in regularly spaced parallel relationship, said cable further having a plurality of spaced second cable sections in which said conductors are not held in regularly spaced parallel relationship, with adjacent first cable sections being spaced by a second cable section;

each first cable section comprising a laminated carrier film holding said conductors, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer.

9. A cable assembly as set forth in claim 8 wherein said non-flat configuration is substantially circular.

10. A cable assembly as set forth in claim 8 wherein the holding means comprises an outer jacket formed of an abrasion resistant thermoplastic material.

11. A cable assembly as set forth in claim 8 wherein said jacket has spaced indicia on its outside surface locating said first cable sections.

12. A cable assembly as set forth in claim 8 wherein said conductors are arranged in twisted pairs in said second cable sections.

13. A cable assembly as set forth in claim 8 further including a central strength member.

14. A cable assembly as set forth in claim 8 wherein said flat cable is spiralled to form said non-flat configuration.

15. A cable assembly as set forth in claim 8 wherein said flat cable is folded to form said non-flat configuration.

16. A cable assembly as set forth in claim 8 further comprising a metallic shield surrounding said cable.

17. A cable assembly as set forth in claim 16 wherein said shield is a foil.

18. A cable assembly as set forth in claim 16 wherein said shield is a braid.

19. A cable assembly as set forth in claim 16 wherein said shield comprises a foil layer and a braid layer.

20. A flat cable for use with a mass termination connector having a plurality of regularly spaced terminal elements, said cable comprising:

a plurality of discrete conductors extending throughout the length of said cable, each conductor having an insulative jacket made of a thermoplastic material;

said cable having a plurality of spaced first cable sections in which said conductors are held in regularly spaced parallel relationship, said cable further having a plurality of spaced second cable sections in which said conductors are not held in regularly spaced parallel relationship, with adjacent first cable sections being spaced by a second cable section;

each first cable section comprising a laminated carrier film holding said conductors, said carrier film including an attachment layer of thermoplastic insulation having a melting temperature similar to that of the jacket material, and a dimensional stabilization layer made of an insulative material having a melting temperature higher than those of the attachment layer and the jacket material and displaying dimensional stability at the melting temperatures of the attachment layer and jacket material, the jackets of said conductors being fused to said attachment layer and said attachment layer being held by said stabilization layer, wherein said laminated carrier film is a first carrier film and is disposed on one side of said first cable section, each first cable section further comprising a second carrier film disposed on the other side of said first cable section, said second carrier film including an attachment layer of thermoplastic insulation having a melting temperature similar to that of the jacket material.

21. A flat cable as set forth in claim 20 wherein the attachment layer of said second carrier film and the attachment layer of said first carrier film are fused to each other between the conductors of each pair of adjacent conductors so that each side of each first cable section is undulating with each undulation formed by one of the jacketed conductors, the spacing between undulations matching the spacing between terminal elements.

22. A flat cable as set forth in claim 21 wherein said second carrier film further comprises a dimensional stabilization layer made of an insulative material having a melting temperature higher than those of the attachment layers and the jacket material.

23. A flat cable for use with a mass termination connector having a plurality of regularly spaced terminal elements, said cable comprising:

a plurality of discrete conductors extending throughout the length of said cable, each conductor having an insulative jacket made of a thermoplastic material;

said cable having a plurality of spaced first cable sections in which said conductors are held in regularly spaced parallel relationship and have undulations on each side of the cable formed by said conductors matching the spacing of said terminal elements, said cable further having a plurality of spaced second cable sections in which said conductors are not held in regularly spaced parallel relationship, with adjacent first cable sections being spaced by a second cable section;

each first section comprising a first film disposed on one side of the conductors and a second film disposed on the other side of said conductors, each film including an attachment layer with the attachment layers being fused together between each pair of adjacent conductors, at least one of said films comprising a dimensional stabilization layer made of an insulative material having a melting temperature higher than those of said attachment layers and displaying dimensional stability at the melting temperatures of said attachment layers, the dimensional stabilization layer holding the attachment layer in said one film.

24. A flat cable as set forth in claim 23 wherein the attachment layers in each first section have melting temperatures similar to that of the jacket material, said attachment layers also being fused to the jackets of said conductors.

25. A flat cable as set forth in claim 23 wherein each of said films in each first section comprises a said dimensional stabilization layer holding a corresponding attachment layer.

26. A flat cable as set forth in claim 23 wherein said conductors in said second cable sections are arranged in twisted pairs.

27. A cable assembly as set forth in claim 8 further including at least one central filler.

* * * * *

UNITED STATES PATENT AND TRADEMARK OFFICE

CERTIFICATE OF CORRECTION

PATENT NO. : 4,767,891

DATED : August 30, 1988

INVENTOR(S) : Robert J. Biegon et al.

It is certified that error appears in the above-identified patent and that said Letters Patent is hereby corrected as shown below: Title page:

In the References, Under "Gressitt et al.", change Class from "74" to --174--..

In the Abstract, line 9, change "insulatioln" to --insulation--.

Column 3, line 4, change "conductors" to --conductor--.

Column 5, line 19, after "film" insert --24--.

Column 5, line 35, change "attachement" to --attachment--.

Column 5, line 44, change "termiation" to --termination--.

Column 5, line 49, change "conductor" to --conductors--.

UNITED STATES PATENT AND TRADEMARK OFFICE

CERTIFICATE OF CORRECTION

PATENT NO. : 4,767,891

DATED : August 30, 1988

INVENTOR(S) : Robert J. Biegon et al.

It is certified that error appears in the above-identified patent and that said Letters Patent is hereby corrected as shown below:

Column 6, line 1, change "by" to --be--.

Column 6, line 36, replace the comma with --and--.

Column 6, line 46, change "stripes" to --stripe--.

Column 7, line 40, change "temprature" to --temperature--.

Column 7, line 42, delete "," (comma).

Column 7 line 48, change "elments" to --elements--.

Signed and Sealed this

Twenty-fourth Day of January, 1989

*Attest:*

*Attesting Officer*

DONALD J. QUIGG

*Commissioner of Patents and Trademarks*